US005877460A

United States Patent [19]

Stachowski

[11] Patent Number: 5,877,460

[45] Date of Patent: Mar. 2, 1999

[54] DEVICE FOR TALKING UNDERWATER

[76] Inventor: Ritchie C. Stachowski, 370 Park St., Moraga, Calif. 94556

[21] Appl. No.: 931,865

[22] Filed: Sep. 16, 1997

[51] Int. Cl.[6] ..... G10K 11/00

[52] U.S. Cl. ..... 181/127; 181/21

[58] Field of Search ..... 181/18, 21, 126, 181/127, 141; 128/201.11, 201.19; 367/132

[56] References Cited

U.S. PATENT DOCUMENTS

| | | | |
|---|---|---|---|
| 2,844,212 | 7/1958 | Hogan et al. | 181/18 |
| 3,140,754 | 7/1964 | Motsinger | 181/18 |
| 3,828,887 | 8/1974 | Alexander | 181/127 |
| 4,071,110 | 1/1978 | Payne | 181/127 |
| 4,183,422 | 1/1980 | Williams . | |
| 4,527,657 | 7/1985 | Payne . | |
| 5,493,079 | 2/1996 | Anderson . | |

*Primary Examiner*—Khanh Dang

*Attorney, Agent, or Firm*—Lumen Intellectual Property Services

[57] ABSTRACT

A device for talking underwater comprising a body made of a rigid material with a large opening and a small opening. The large opening has a thin diaphragm cover and the small opening has a mouth fitting for forming an airtight seal around a users mouth. Speaking into the device through the mouth fitting sends sound waves to the diaphragm which transmits the sound vibrations to the water. One-way blow valves in the side of the body allow exhaled air to escape while speaking into the device. The blow valves do not allow water to enter the body. The blow valves are constructed such that bubbles released to the surrounding water are too small to produce excessive amounts of disruptive noise. The body is preferably cone-shaped, but can be any shape, provided it has large and small openings.

13 Claims, 5 Drawing Sheets

DEVICE FOR TALKING UNDERWATER

FIELD OF THE INVENTION

This invention relates generally to underwater communications devices, and, more specifically, to nonelectronic devices for talking underwater.

BACKGROUND OF THE INVENTION

In many situations it would be desirable to have an inexpensive device to communicate by voice underwater. Divers, snorkelers and swimmers, for example, could use such a device. Also, such a device could be used as a toy.

A large difficulty in designing devices for talking underwater is in transferring the air sound waves of the voice to water sound waves while avoiding the formation of loud, disruptive air bubbles. Air exhaled while talking can form loud bubbles if allowed to freely escape into the surrounding water. Bubbles can often be loud enough to mask the voice of the speaker. The bubble noise problem is addressed in several prior art devices.

U.S Pat. No. 4,183,422 to Williams discloses a nonelectronic device for speaking underwater which uses an elastic bag which fits over the mouth. The bag surface functions as a diaphragm and so allows the transmission of sound waves. The bag also functions to prevent any air from escaping, which completely prevents the formation of disruptive air bubbles. This invention requires that the bag be at least partially inflated before speaking. A problem with this invention is that the bag is fragile and can be easily damaged.

U.S. Pat. No. 5,493,079 to Anderson discloses a nonelectronic device for speaking underwater which uses a tuned diaphragm attached to a snorkel tube. The tuned diaphragm couples sound waves to the water and the snorkel tube allows the speakers exhaled air to escape to the water surface without forming air bubbles. This solution requires that the speaker be very close to the water surface because loud bubbles will be created if the snorkel is submerged. Another difficulty with this invention is the fact that it requires the diaphragm to be tuned to the frequency range of 1500–3000 hertz. This can require more than one diaphragm. This invention also requires the inclusion of flexible lips for articulating plosive sounds. This is necessary because the invention is attached to a snorkel tube which is held in the mouth by the teeth.

U.S. Pat. No. 4,527,657 to Payne discloses a nonelectric device for speaking underwater which uses a special impedance matched tapered tube for transferring the sound waves to the water. Exhaled air is passed through a bubbles silencer which is worn around the users neck. The silencer consists of two rubber sheets bonded together around the edges. The rear portion of the silencer has an opening between the rubber sheets which allows the air to escape without making a lot of noise. However, the bubbles released are not substantially reduced in size by the bubbles silencer. This invention is rather sophisticated and expensive and, as such, is not intended for casual use by swimmers and snorkelers.

OBJECTS AND ADVANTAGES OF THE INVENTION

It is therefore an object of the present invention to provide a device for talking underwater that:

1) is inexpensive, 2) is nonelectronic, 3) is not limited to use near the water surface, 4) is not fragile, 5) does not require the mouthpiece to be held in the mouth, and 6) is effective at reducing the disruptive sound of air bubbles.

SUMMARY OF THE INVENTION

These objects and advantages are attained by a preferably cone-shaped device with a small opening and a large opening on opposite ends. The body of the device can be made out of any rigid plastic material and can be any shape provided that it has a small opening and a large opening. The small opening has an elastomeric mouth fitting for comfortably forming a water-tight seal around the users mouth. The mouth fitting is not held in the mouth, so the users lips are free to articulate sounds inside the device. The large opening has a thin diaphragm cover.

The side of the body has at least one one-way blow valve for releasing exhaled air into the surrounding water. The blow valves are constructed such that the exhaled air is released in the form of small bubbles. Small bubbles are much quieter than large bubbles and so do not interfere with hearing underwater.

The present invention is used by placing the elastomeric mouth fitting over the mouth to form a water tight seal and going underwater. The body is thus filled with air. Speaking into the device produces sound waves which are incident upon the thin diaphragm. The sound vibrations are transferred to the water by means of the vibrating diaphragm. Air exhaled while talking is allowed to escape through the one-way blow valves. This does not produce bubble noise because the blow valves are constructed to release the air in the form of small bubbles, which are relatively silent.

DETAILED DESCRIPTION

Figure 1:
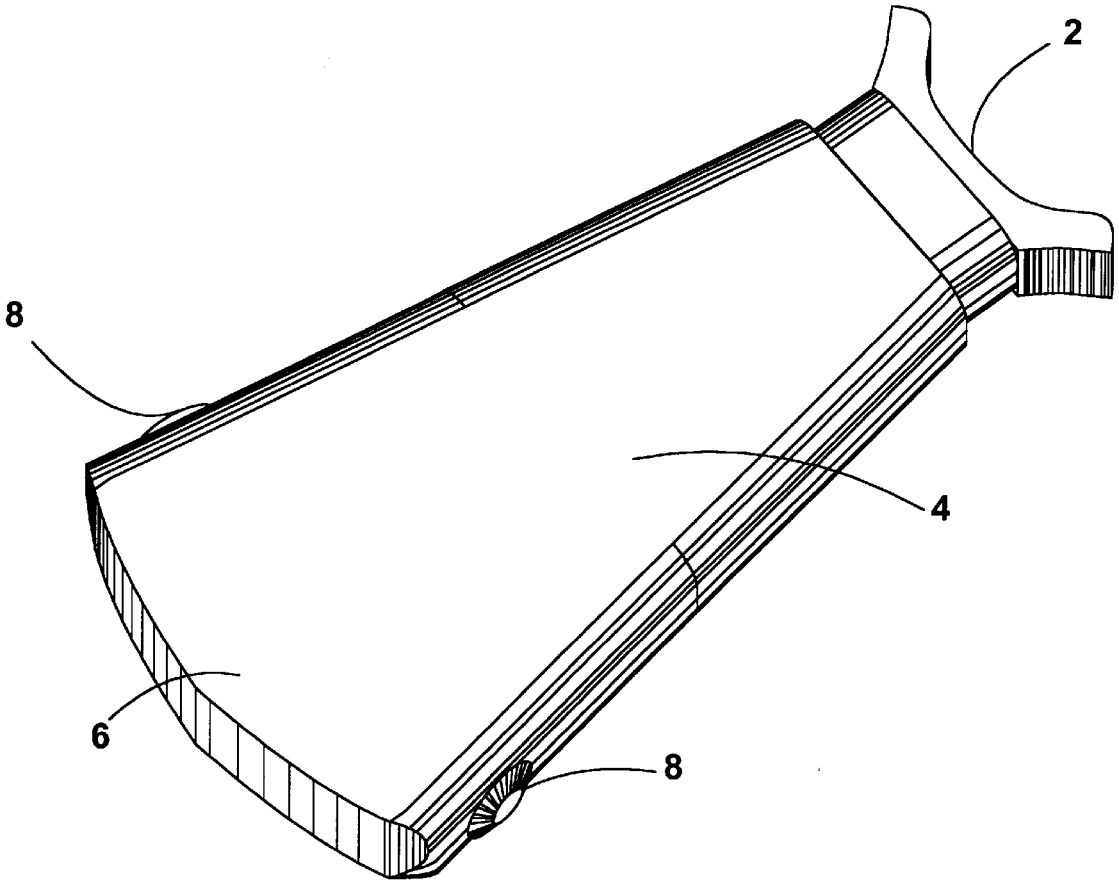
FIG. 1 is a perspective view of the present invention.

A preferred embodiment of the invention is shown in FIG. 1. An elastomeric mouth fitting 2 is bonded to the small opening of a body 4 and a diaphragm 6 covers a large opening of the body 4. The mouth fitting/body and diaphragm/body bonds are water-tight. The mouth fitting 2 can be made of any elastomeric material that can comfortably form a water tight seal around the mouth of a user. It is noted that the mouth fitting 2 fits over the users mouth and not inside the users mouth. In this way, the users lips are free to move and articulate sounds into the interior of the body 4. The body 4 can be made of any rigid plastic material that can hold its shape underwater and is waterproof, such as polyethylene or polypropylene. The diaphragm 6 is preferably about 30–60 thousandths of an inch thick and should be less than 100 thousandths. The diaphragm 6 can be made of the same material as the body 4. In fact, the diaphragm 6 can be formed in the same molding step that forms the body 4, producing a diaphragm and body that are monolithic.

Alternatively, the diaphragm 6 can be formed by covering the large opening with a thin layer of diaphragm material. The diaphragm 6 does not need to be in tension.

The embodiment of FIG. 1 has two one-way blow valves 8 with one on each side of the body 4. The blow valves 8 allow air to escape from the interior of the body 4, but do not allow water to enter. The blow valves 8 are constructed such that air released to the surrounding water is in the form of small bubbles. Small bubbles are relatively silent and so do not produce excessive amounts of interfering noise. The bubbles formed by the blow valves should be less than 4 mm in diameter in order to be relatively silent. The preferred embodiment of the present invention releases bubbles in the size range of 1–4 mm.

Figure 2A:
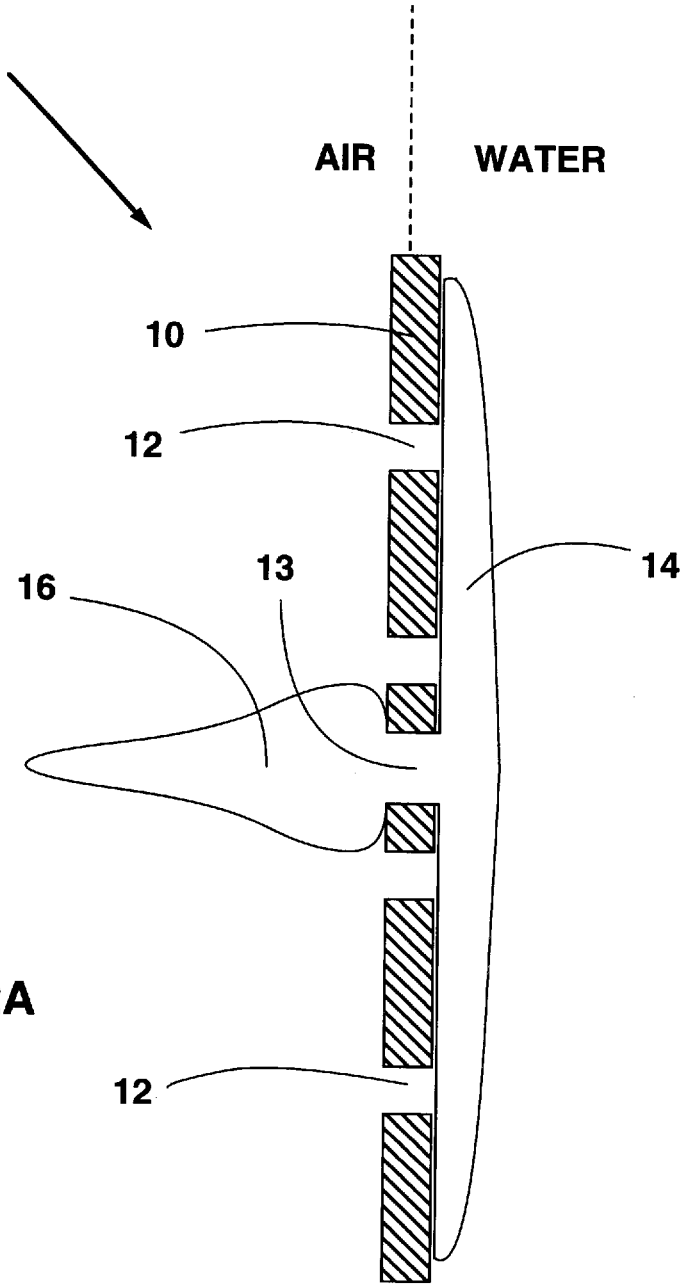
FIG. 2A is a closeup cross-sectional side view of a one-way blow valve in a closed position.

FIG. 2A shows a closeup cross-sectional view of a blow valve 8 used in the present invention with the blow valve in the closed position. The left side is the interior side (air side) of the body 4 and the right side is the outside (water side) of the body 4. The blow valve 8 consists of a rigid plate 10 with several small holes 12 and an elastomeric sheet 14 covering the holes 12 on the water side. The blow valve 8 can be approximately ½ inch in diameter. 4–7 holes 12 are used in each blow valve 8 and the holes 12 can be approximately 0.1 inch to 0.15 inch in diameter. The holes are small enough to produce small bubbles (less than about 4 mm in diameter) when air is forced through them. The rigid plate 10 can be made of the same material as the body 4 and can even be built into the body 4 during the molding. In the preferred embodiment of the present invention, the elastomeric sheet 14 is held in place by a stem 16 which is held captive by a hole 13 in the rigid plate 10. The elastomeric sheet 14 can also be held to the rigid plate 10 with glue or a heat seal.

Figure 2B:
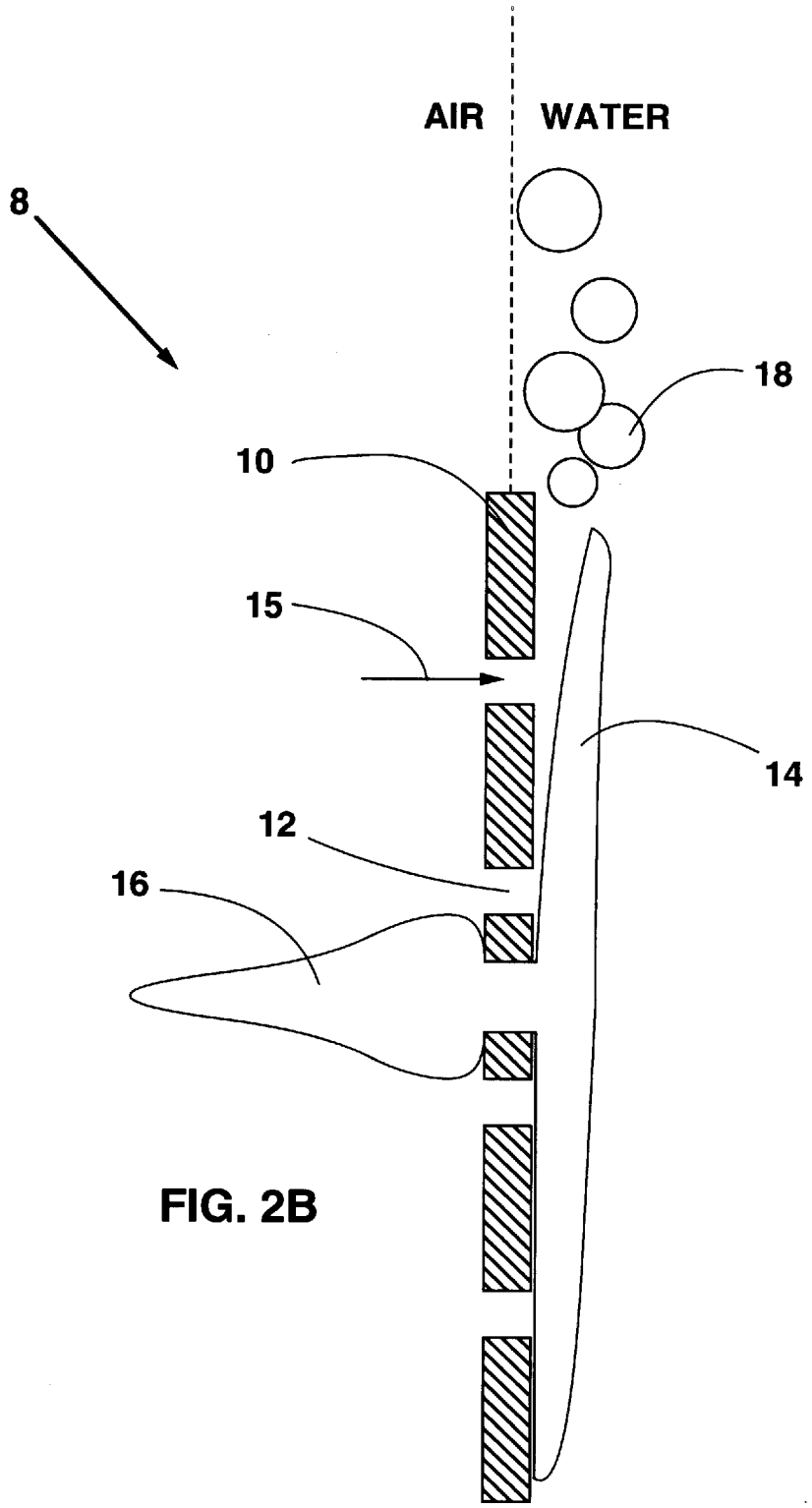
FIG. 2B is a closeup cross-sectional side view of a one-way blow valve in an open position.

FIG. 2B shows a blow valve 8 in an open position. Increased air pressure on the air side (body interior) of the valve 8 pushes the elastomeric sheet 14 away from the rigid plate 10 and air 15 escapes through the holes 12. The increased interior air pressure is due to the user exhaling air while speaking into the mouth fitting 2. The blow valves 8 are one-way and do not allow water to enter the device. The small size of the holes 12 creates small, relatively silent bubbles 18. Smaller holes 12 will produce smaller bubbles 18. Forming small bubbles 18 is important because small bubbles 18 are quiet compared to large bubbles. It is noted that any other kind of one-way valves which produce small bubbles can be used with the present invention. Of course, the valve must be located on the side or top of the body 4 and not on the diaphragm 6.

Figure 3:
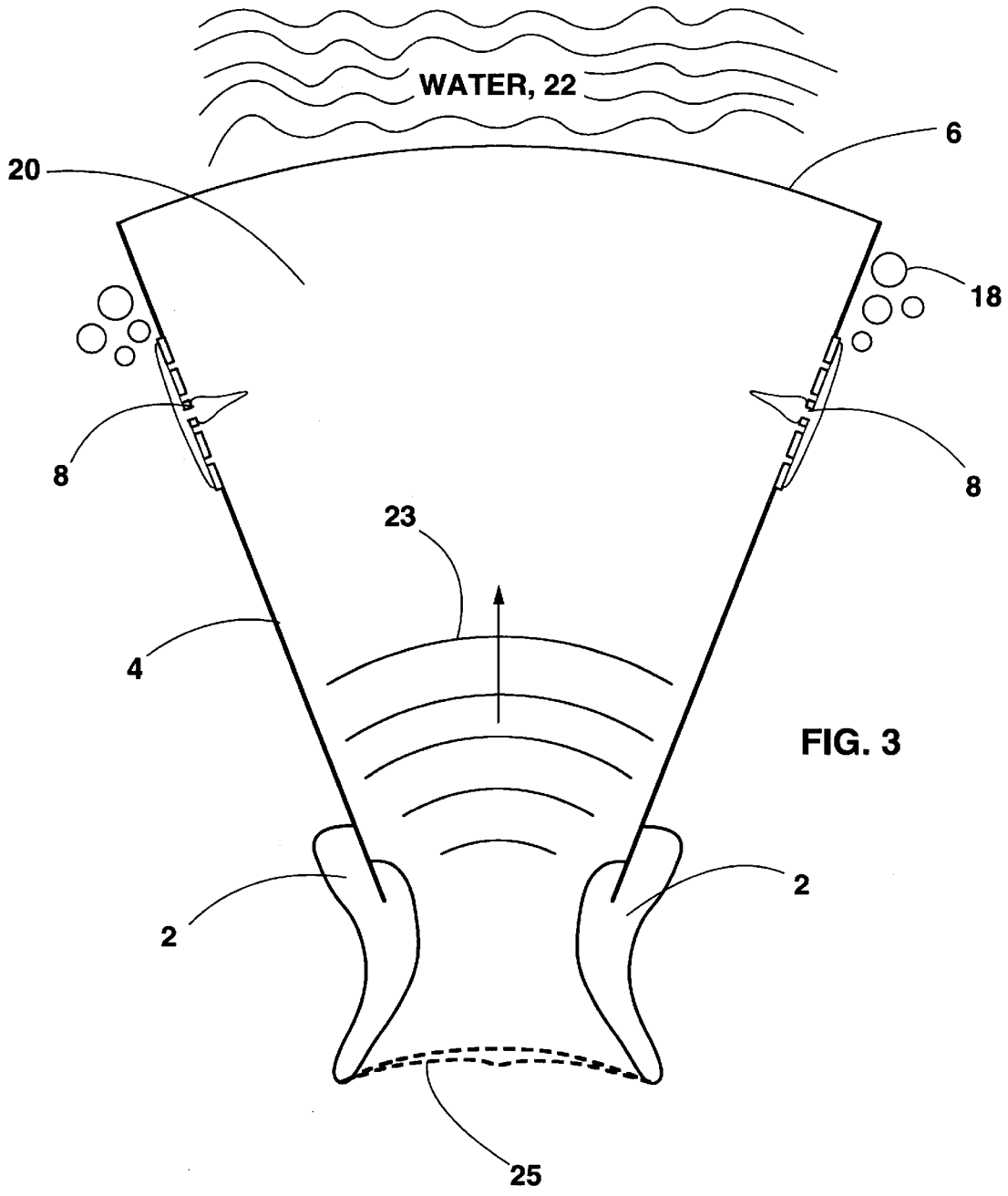
FIG. 3 is a cross-sectional top view of the present invention.

FIG. 3 shows a cross sectional top view and further illustrates the operation of the present invention. The present invention is used by placing the elastomeric mouth fitting 2 over the mouth 25 to form an airtight seal and going underwater. The interior 20 of the body 4 is thus filled with air. Sound waves 23 from speaking into the device are incident upon the diaphragm which transfers the sound vibrations to surrounding water 22. Air exhaled while speaking passes into the interior 20 of the body 4 and ultimately out of the one-way blow valves 8. The blow valves 8 quietly release the air into the surrounding water in the form of small bubbles 18.

Figure 4A:
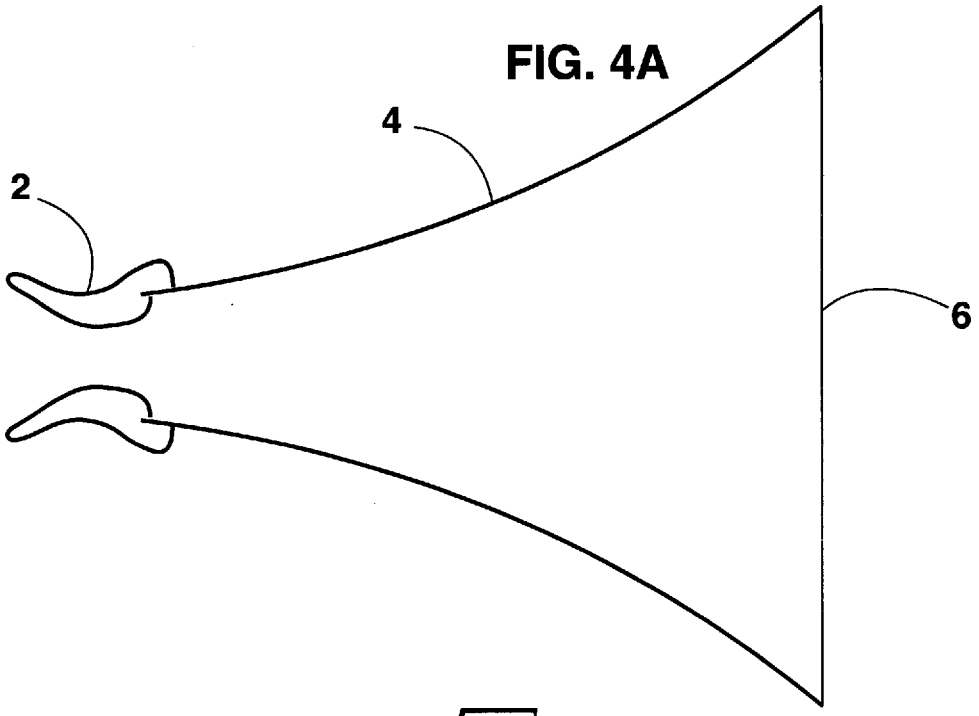
FIGS. 4A and 4B are top views of alternative shapes for the body.
Figure 4B:
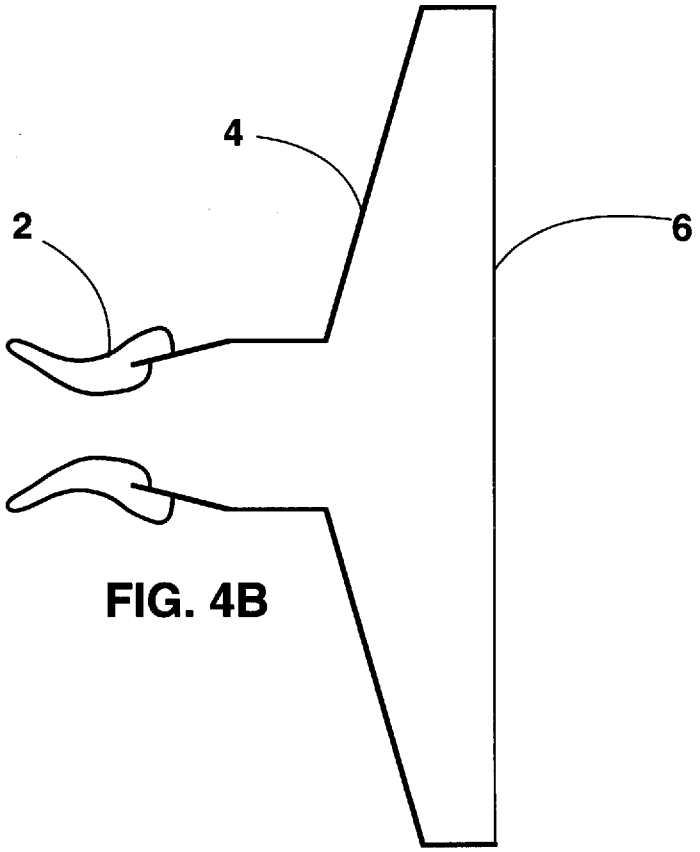

It is noted that the body 4 is preferably cone-shaped as shown in FIGS. 1 and 3. However, the body 4 can be any shape that provides a small opening for the elastomeric mouth fitting 2 and a large opening for mounting the diaphragm 6. Flare shapes and horn shapes as shown in FIGS. 4A and 4B are examples of other body shapes that can be used in the present invention.

It will be clear to one skilled in the art that the above embodiment may be altered in many ways without departing from the scope of the invention. Accordingly, the scope of the invention should be determined by the following claims and their legal equivalents.

What is claimed is:

1. A device for talking underwater, said device comprising:

a) a body having a small opening and a large opening;

b) a thin diaphragm covering said large opening;

c) a mouth fitting surrounding said small opening;

d) at least one one-way blow valve mounted in a wall of said body for allowing exhaled air to escape, wherein said blow valve releases air in the form of bubbles having a diameter less than 5 millimeters;

whereby speaking into said small opening through mouth fitting couples sound waves to surrounding water through said diaphragm.

2. The device of claim 1 wherein said one-way blow valve comprises an elastomeric sheet covering a rigid plate with small holes.

3. The device of claim 2 wherein said small holes are approximately 0.1 to 0.15 inch in diameter.

4. The device of claim 1 wherein said body is substantially cone-shaped.

5. The device of claim 1 wherein said thin diaphragm is approximately 30–60 thousandths of an inch thick.

6. The device of claim 1 wherein said body is made of a material selected from the group consisting of polyethylene and polypropylene.

7. The device of claim 1, wherein said thin diaphragm is made of a material selected from the group consisting of polyethylene and polypropylene.

8. A device for talking underwater, said device comprising:

a) a body having a small opening and a large opening;

b) a thin diaphragm covering said large opening;

c) a mouth fitting surrounding said small opening;

d) at least one one-way blow valve mounted in a wall of said body for allowing exhaled air to escape, wherein said one-way blow valve comprises an elastomeric sheet covering a rigid plate with small holes;

whereby speaking into said small opening through mouth fitting couples sound waves to surrounding water through said diaphragm.

9. The device of claim 8 wherein said small holes are approximately 0.1 to 0.15 inch in diameter.

10. The device of claim 8 wherein said body is substantially cone-shaped.

11. The device of claim 8 wherein said thin diaphragm is approximately 30–60 thousandths of an inch thick.

12. The device of claim 8 wherein said body is made of a material selected from the group consisting of polyethylene and polypropylene.

13. The device of claim 8 wherein said thin diaphragm is made of a material selected from the group consisting of polyethylene and polypropylene.

* * * * *

UNITED STATES PATENT AND TRADEMARK OFFICE

CERTIFICATE OF CORRECTION

PATENT NO. : 5,877,460

DATED : March 2, 1999

INVENTOR(S) : Richie C. Stachowski

It is certified that error appears in the above-identified patent and that said Letters Patent is hereby corrected as shown below:

On the title page, Item [76], change "Ritchie" to --Richie--.

Signed and Sealed this

Fifteenth Day of June, 1999

*Attest:*

Q. TODD DICKINSON

*Attesting Officer*

*Acting Commissioner of Patents and Trademarks*